US011290829B2

(12) United States Patent
Chen et al.

(10) Patent No.: US 11,290,829 B2
(45) Date of Patent: Mar. 29, 2022

(54) HEARING ASSISTANCE SYSTEM

(71) Applicant: Compal Electronics, Inc., Taipei (TW)

(72) Inventors: Yi-Ching Chen, Taipei (TW); Yun-Chiu Ching, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 325 days.

(21) Appl. No.: 16/660,355

(22) Filed: Oct. 22, 2019

(65) Prior Publication Data

US 2021/0058719 A1 Feb. 25, 2021

(30) Foreign Application Priority Data

Aug. 19, 2019 (TW) ..... 108129521

(51) Int. Cl.
*H04R 25/00* (2006.01)

(52) U.S. Cl.
CPC ..... *H04R 25/558* (2013.01); *H04R 25/43* (2013.01); *H04R 25/505* (2013.01); *H04R 25/70* (2013.01); *H04R 2225/41* (2013.01)

(58) Field of Classification Search
CPC .... H04R 25/558; H04R 25/43; H04R 25/505; H04R 25/70; H04R 2225/41
USPC ..... 381/315
See application file for complete search history.

(56) References Cited

U.S. PATENT DOCUMENTS

| | | | | |
|---|---|---|---|---|
| 9,361,872 | B2 | 6/2016 | Park et al. | |
| 9,380,374 | B2 | 6/2016 | Sprague et al. | |
| 9,843,874 | B2 | 12/2017 | Chen | |
| 10,123,139 | B2 | 11/2018 | Chen | |
| 2015/0003623 | A1 | 1/2015 | Rasmussen | |
| 2016/0073203 | A1 | 3/2016 | Kuriger | |
| 2020/0007995 | A1 * | 1/2020 | Pedersen | H04R 25/356 |

FOREIGN PATENT DOCUMENTS

| | | | |
|---|---|---|---|
| TW | 200920159 | A | 5/2009 |
| TW | I345923 | B | 7/2011 |
| TW | I613920 | B | 2/2018 |
| TW | M563123 | U | 7/2018 |

* cited by examiner

*Primary Examiner* — Sean H Nguyen
(74) *Attorney, Agent, or Firm* — Kirton McConkie; Evan R. Witt

(57) ABSTRACT

A hearing assistance system is provided. The hearing assistance system includes a first assisting device and a second assisting device. The first assisting device includes a first sound collection module, a first audio processing unit, a first audio output module and a first communication unit. The second assisting device includes a second sound collection module, audio processing module, a second audio output module, a processor unit and a second communication unit. The processor unit outputs a second control signal according to a first audio signal and a second audio signal by mutual communication between the communication units. The audio processing module outputs a second output audio signal to the second audio output module in accordance with the second control signal, so that the second audio output module outputs the second sound in accordance with the second output audio signal.

20 Claims, 4 Drawing Sheets

HEARING ASSISTANCE SYSTEM

CROSS-REFERENCE TO RELATED APPLICATION

This application claims priority to Taiwan Patent Application No. 108129521, filed on Aug. 19, 2019, the entire content of which is incorporated herein by reference for all purposes.

FIELD OF THE DISCLOSURE

The present disclosure relates to a hearing assistance system, and more particularly to a hearing assistance system for assisting users to have a spatial perception.

BACKGROUND OF THE DISCLOSURE

With the advancement of technology, assisting tool for hearing impaired people in modern technology products increases, such as hearing assisting device. According to the audibility curves of each ear of the user, the prior hearing assisting device performs hearing compensation on the source sound and outputs the compensated sound to the eardrum of the user. Therefore, the user is able to clearly hear the sound in appropriate volume.

However, the prior hearing assisting device performs compensation on the source sounds of the two ears separately without considering the volume relationship between the source sounds of the two ears. Hence, the volume of the compensated sound is easily distorted. The normal hearing people can determine the sound orientation and have the spatial perception through the volume of the sound received simultaneously by both ears. The hearing impaired people have to wear the hearing assistance system for assisting compensating the source sound, so that the hearing impaired people can hear the source sound. If the volume of the compensated sound is distorted, the user is unable to determine the sound orientation and have the spatial perception according to the sound volume heard by the two ears. Further, the daily life and safety of the user may be affected or even endangered. For example, the user is unable to determine the orientation, relative to the user, of the person calling the user, or even the user is unable to determine the orientation, relative to the user, of the vehicles.

Therefore, there is a need of providing a hearing assistance system in order to overcome the above drawbacks.

SUMMARY OF THE DISCLOSURE

An object of the present disclosure provides a hearing assistance system. Through the audio signal transmission of the communication unit, the hearing assistance system can perform volume compensation with comprehensively considering the hearing loss level of the two ears and the sound volume heard by the two ears. Therefore, the volume relationship between the sounds heard by the two ears of the user is consistent with that between the source sounds of the two ears. The user is allowed to correctly determine the sound orientation and have the spatial perception.

In accordance with an aspect of the present disclosure, there is provided a hearing assistance system. The hearing assistance system includes a first assisting device and a second assisting device. The first assisting device includes a first sound collection module, a first audio processing unit, a first audio output module and a first communication unit. The first sound collection module is configured for receiving a first source sound. The first audio processing unit is electrically connected to the first sound collection module and is configured for performing audio processing on the first source sound and generating a first audio signal. The first audio output module is electrically connected to the first audio processing module. The first communication unit is electrically connected to the first audio processing unit and is configured for transmitting the first audio signal. The second assisting device includes a second sound collection module, a second audio processing module, a second audio output module, a processor unit and a second communication unit. The second sound collection module is configured for receiving a second source sound. The second audio processing module is electrically connected to the second audio collection module and is configured for performing audio processing on the second source sound and generating a second audio signal. The second audio output module is electrically connected to the audio processing module. The processor unit is electrically connected to the audio processing module for receiving the second audio signal. The second communication unit is electrically connected to the processor unit and is configured for receiving the first audio signal. The processor unit generates a second control signal in accordance with the first audio signal and the second audio signal. The audio processing module outputs a second output audio signal to the second audio output module in accordance with the second control signal, and the second audio outputs module outputs a second sound in accordance with the second output audio signal.

In accordance with an aspect of the present disclosure, there is further provided a hearing assistance system. The hearing assistance system includes a first assisting device and a second assisting device. The first assisting device includes a first sound collection module, a first audio processing module, a first audio output module, a first processor unit and a first communication unit. The first sound collection module is configured for receiving a first source sound. The first audio processing unit is electrically connected to the first sound collection module and is configured for performing audio processing on the first source sound and generating a first audio signal. The first audio output module is electrically connected to the first audio processing module. The first processor unit is electrically connected to the first audio processing module. The first communication unit is electrically connected to the first audio processing unit and is configured for transmitting the first audio signal. The second assisting device includes a second sound collection module, a second audio processing module, a second audio output module, a second processor unit and a second communication unit. The second sound collection module is configured for receiving a second source sound. The second audio processing module is electrically connected to the second audio collection module and is configured for performing audio processing on the second source sound and generating a second audio signal. The second audio output module is electrically connected to the second audio processing module. The second processor unit is electrically connected to the second audio processing module. The second communication unit is electrically connected to the second processor unit and is configured for transmitting the second audio signal. The first communication unit and the second communication unit communicate with each other for transmitting the first audio signal and the second audio signal to each other. The first processor unit outputs a first control signal to the first audio processing module in accordance with the first and second audio signals. The first audio processing module outputs a first output audio signal to the first audio output module in accordance with the first control signal. The first audio output module outputs a first sound in accordance with the first output audio signal. The second processor unit outputs a second control signal to the second audio processing module in accordance with the first and second audio signals. The second audio processing module outputs a second output audio signal to the second audio output module in accordance with the second control signal. The second audio output module outputs a second sound in accordance with the second output audio signal.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 1:
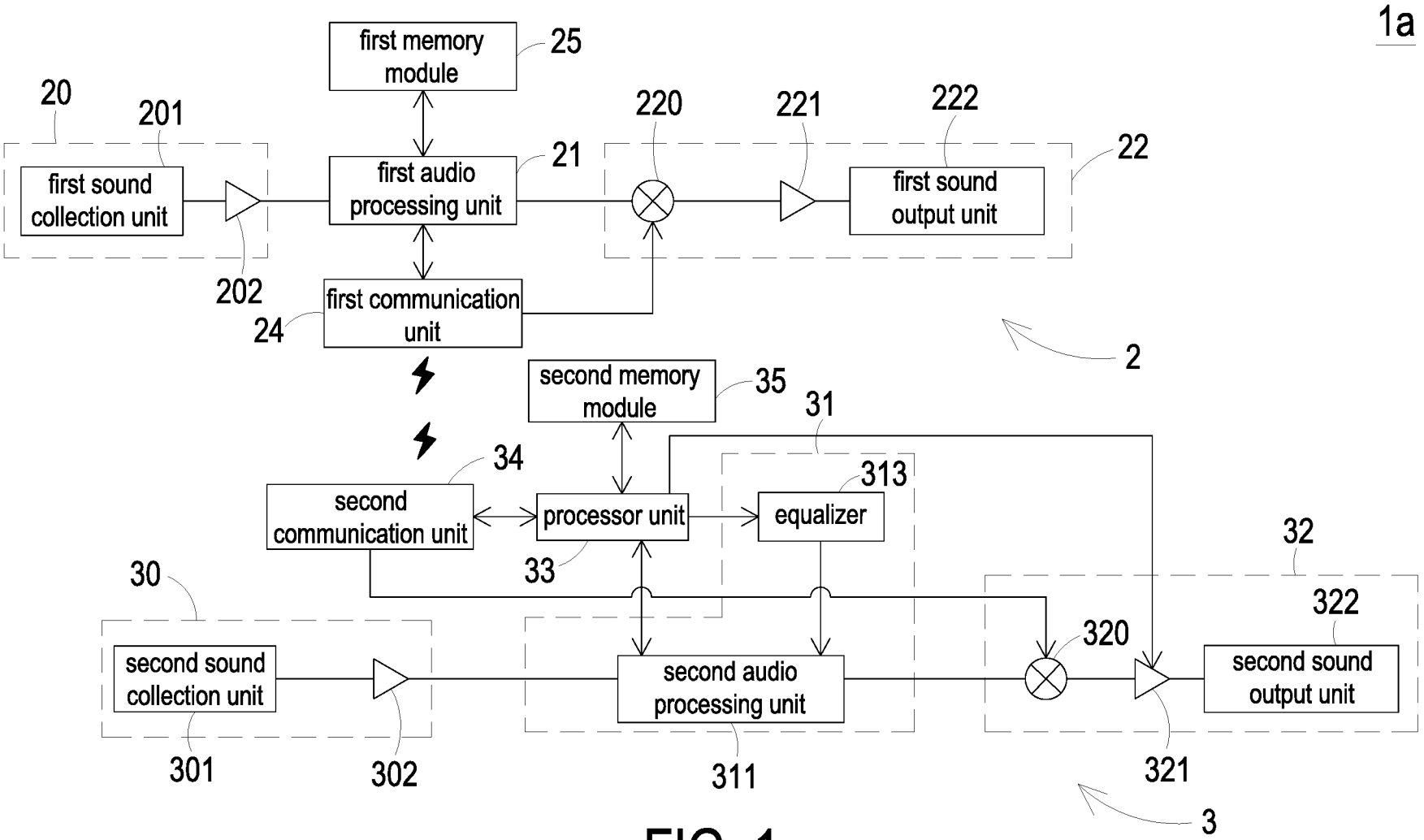
FIG. 1 is a schematic circuit diagram illustrating a hearing assistance system according to a first embodiment of the present disclosure.

FIG. 1 is a schematic circuit diagram illustrating a hearing assistance system according to a third embodiment of the present disclosure. As shown in FIG. 1, the hearing assistance system 1*a* includes a first assisting device 2 and a second assisting device 3. The first assisting device 2 includes a first sound collection module 20, a first audio processing unit 21, a first audio output module 22 and a first communication unit 24. The first audio processing unit 21 is electrically connected to the first sound collection module 20, the first audio output module 22 and the first communication unit 24 respectively.

The second assisting device 3 includes a second sound collection module 30, an audio processing module 31, a second audio output module 32, a processor unit 33 and a second communication unit 34. The audio processing module 31 is electrically connected to the second sound collection module 30, the processor unit 33 and the second audio output module 32 respectively. The processor unit 33 is electrically connected to the second communication unit 34 and the second audio output module 32.

The first sound collection module 20 receives and transmits a first source sound to the first audio processing unit 21. The first audio processing unit 21 performs audio processing on the first source sound and outputs a first audio signal to the first communication unit 24. The first audio signal includes a first source-sound parameter signal and a first adjusting audio signal. The first source-sound parameter signal is an output parameter signal based on the first source sound. The first adjusting audio signal is an audio signal generated by processing the first source sound with wide dynamic range compression and adjusting the processed first source sound according to the matching formula (e.g., DSL, NAL-NL-2). The second sound collection module 30 receives and transmits a second source sound to the audio processing module 31. The audio processing module 31 performs audio processing on the second source sound and outputs a second audio signal to the processor unit 23. The second audio signal includes a second source-sound parameter signal and a second adjusting audio signal. The second source-sound parameter signal is an output parameter signal based on the second source sound. The second adjusting audio signal is an audio signal generated by processing the second source sound with wide dynamic range compression and adjusting the processed second source sound according to the matching formula (ex. DSL, NAL-NL-2). The source-sound parameter signal is a value of the volume of source sound, and the unit of the value is for example but not limited to decibel (dB). In an embodiment, the source sound is the nature audio coming from the sounds heard by the human ear in a normal living environment, such as the conversation among people, the sound of insects and birds, etc. Through sampling, quantizing and other audio processing technologies, the first audio processing unit 21 and the audio processing module 31 convert the analog audio into digital audio.

The second communication unit 34 is communicated with the first communication unit 24 for receiving the first audio signal. The processor unit 33 operates according to the first and second audio signals and outputs a second control signal. The first audio processing unit 21 processes the first source sound with wide dynamic range compression and outputs a first output audio signal to the first audio output module 22. The first audio output module 22 outputs a first sound to one ear of the user in accordance with the first output audio signal. The audio processing module 31 receives the second control signal and outputs a second output audio signal to the second audio output module 32. The second audio output module 32 outputs a second sound to the other ear of the user in accordance with the second output audio signal.

Consequently, through performing the audio processing and volume adjustment on the first and second source sounds by the first audio processing unit 21, the audio processing module 31 and the processor unit 33, the first and second sounds outputted at last have the volume characteristics corresponding to the first and second source sounds. On the other hand, the first sound is generated via the wide dynamic range compression, and the second sound is generated via the wide dynamic range compression and the second control signal. By the one-sided tuning of the second assisting device 3, the user is able to determine the source orientation of the first and second source sounds in accordance with the first and second sounds heard by ears, and thus the user is allowed to have the spatial perception.

In this embodiment, the specific operating and adjustment process of the hearing assistance system 1*a* to the source sound is exemplified and described as follow.

The first audio processing unit 21 performs audio processing on the first source sound according to the parameter (e.g., the audibility curve of one ear) defaulted in the first assisting device 2, and outputs the first adjusting audio signal accordingly. The audio processing module 31 performs audio processing on the second source sound according to the parameter (e.g., the audibility curve of the other ear) defaulted in the second assisting device 3, and outputs the second adjusting audio signal accordingly.

In accordance with the volume relationship between the first and second source-sound parameter signals (i.e., the volume relationship between the first and second source sounds) and the volume relationship between the first and second adjusting audio signals, the processor unit 33 adjusts the first and second adjusting audio signals and outputs the second control signal accordingly. The second control signal is used for controlling the audio processing module 31 to generate the corresponding output audio signal. The way of the processor unit 33 adjusting the adjusting audio signal is detailed in Table 1. In Table 1 and the corresponding descriptions, the comparison and adjustment to the audio signal are performed on the volume of the adjusting audio signal. The manners of comparison are not limited to the total volume or the volume of each channel.

TABLE 1

The reference table of the control signal adjusting the volume

| the volume of source sound | the volume of adjusting audio signal | the way of the control signal adjusting the volume |
|---|---|---|
| the first source sound = the second source sound | the first adjusting audio signal = the second adjusting audio signal ±1 dB | no adjustment |
| | the first adjusting audio signal > the second adjusting audio signal | increasing the second adjusting audio signal successively by 1 dB until reaching the first adjusting audio signal |
| | the first adjusting audio signal < the second adjusting audio signal | decreasing the second adjusting audio signal successively by 1 dB until reaching the first adjusting audio signal |
| the first source sound > the second source sound | the first adjusting audio signal = the second adjusting audio signal ±1 dB | decreasing the second adjusting audio signal by 3 dB |
| | the first adjusting audio signal > the second adjusting audio signal | no adjustment |
| | the first adjusting audio signal < the second adjusting audio signal | decreasing the second adjusting audio signal successively by 1 dB until the second adjusting audio signal being 3 dB smaller than the first adjusting audio signal |
| the first source sound < the second source sound | the first adjusting audio signal = the second adjusting audio signal ±1 dB | increasing the second adjusting audio signal by 3 dB |
| | the first adjusting audio signal > the second adjusting audio signal | increasing the second adjusting audio signal successively by 1 dB until the second adjusting audio signal being 3 dB smaller than the first adjusting audio signal |
| | the first adjusting audio signal < the second adjusting audio signal | no adjustment |

For example, in the case that the volume of the first source sound is larger than the volume of the second source sound. If the first adjusting audio signal and the second adjusting audio signal are the same (within an error of 1 dB), the processor unit 33 decreases the second adjusting audio signal by 3 dB and outputs the corresponding second control signal. If the first adjusting audio signal is larger than the second adjusting audio signal, the processor unit 33 performs no adjustment and outputs the second control signal according to the second adjusting audio signal. If the first adjusting audio signal is smaller than the second adjusting audio signal, the processor unit 33 successively decreases the second adjusting audio signal by 1 dB until the second adjusting audio signal is 3 dB smaller than the first adjusting audio signal, and the processor unit 33 outputs the corresponding second control signal.

In an embodiment, the processor unit 33 generates the first control signal according to the first and second audio signals. The second communication unit 34 receives and transmits the first control signal to the first communication unit 24. The first audio processing unit 21 receives the first control signal and outputs the first output audio signal to the first audio output module 22. The first audio output module 22 outputs the first sound to one ear of the user in accordance with the first output audio signal. Therefore, the first and second sounds are both generated via wide dynamic range compression and the control signal, and the effect of creating the spatial perception is achieved by the double-sided tuning.

In an embodiment, the first sound collection module 20 includes a first sound collection unit 201 and a first gain amplifier 202 electrically connected to each other. The first sound collection unit 201 receives the first source sound, and the first gain amplifier 202 receives and amplifies the first source sound. The first audio processing unit 21 is electrically connected to the first gain amplifier 202 for receiving the amplified first source sound, and the first audio processing unit 21 outputs the first audio signal.

In an embodiment, the first audio output module 22 includes a first mixer 220, a first output amplifier 221 and a first sound output unit 222. The first mixer 220 is electrically connected to the first audio processing unit 21 and is configured for receiving and outputting the first output audio signal. The first output amplifier 221 is electrically connected to the first mixer 220 and is configured for receiving and amplifying the first output audio signal. The first sound output unit 222 is electrically connected to the first output amplifier 221 for receiving the amplified first output audio signal, and the first sound output unit 222 outputs the first sound. In an embodiment, the first communication unit 24 receives a first external audio signal. The first external audio signal can be Bluetooth music signal supporting A2DP, TWS+ (TrueWireless Stereo Plus). The first mixer 220 is electrically connected to the first communication unit 24 for receiving the first external audio signal, and the first mixer 220 outputs one of the received first external audio signal and the received first output audio signal.

In an embodiment, the second sound collection module 30 includes a second sound collection unit 301 and a second gain amplifier 302 electrically connected to each other. The second sound collection unit 301 receives the second source sound, and the second gain amplifier 302 receives and amplifies the second source sound.

In an embodiment, the audio processing module 31 includes a second audio processing unit 311 and an equalizer 313. The second audio processing unit 311 is electrically connected to the second gain amplifier 302, the processor unit 33 and the second audio output module 32 of the second sound collection module 30. The second audio processing unit 311 receives and performs audio processing on the amplified second source sound, and outputs the second audio signal to the processor unit 33. The equalizer 313 is electrically connected between the processor unit 33 and the second audio processing unit 311. The equalizer 313 receives the second control signal and controls the second audio processing unit 311 to output the second output audio signal to the second audio output module 32 in accordance with the second control signal.

In an embodiment, the second audio output module 32 includes a second mixer 320, a second output amplifier 321 and a second sound output unit 322. The second mixer 320 is electrically connected to the second audio processing unit 311 of the audio processing module 31 and is configured for receiving and outputting the second output audio signal. The second output amplifier 321 is electrically connected to the second mixer 320 and is configured for receiving and amplifying the second output audio signal. The second sound output unit 322 is electrically connected to the second output amplifier 321 and is configured for receiving the amplified second output audio signal and outputting the second sound. The second output amplifier 321 amplifies the second output audio signal according to a first parameter. The second output amplifier 321 is electrically connected to the processor unit 33, and the processor unit 33 can control and adjust the first parameter. In an embodiment, the second communication unit 34 receives the second external audio signal. The second external audio signal can be Bluetooth music signal supporting A2DP and TWS+. The second mixer 320 is electrically connected to the second communication unit 34 for receiving the second external audio signal, and the second mixer 320 outputs one of the received second external audio signal and the received second output audio signal.

In an embodiment, the first assisting device 2 further includes a first memory module 25 electrically connected to the first audio processing unit 21. The first memory module 25 is configured to store the data and parameters in the first assisting device 2. The second assisting device 3 further includes a second memory module 35 electrically connected to the processor unit 33. The second memory module 35 is configured to store the data and parameters in the second assisting device 3.

In an embodiment, preferably but not exclusively, the first communication unit 24 and the second communication unit 34 are communicated with each other via wireless transmission system (e.g., Bluetooth, Wifi and Zigbee). In an embodiment, the first communication unit 24 and the second communication unit 34 are communicated with each other via wired transmission system.

Figure 2:
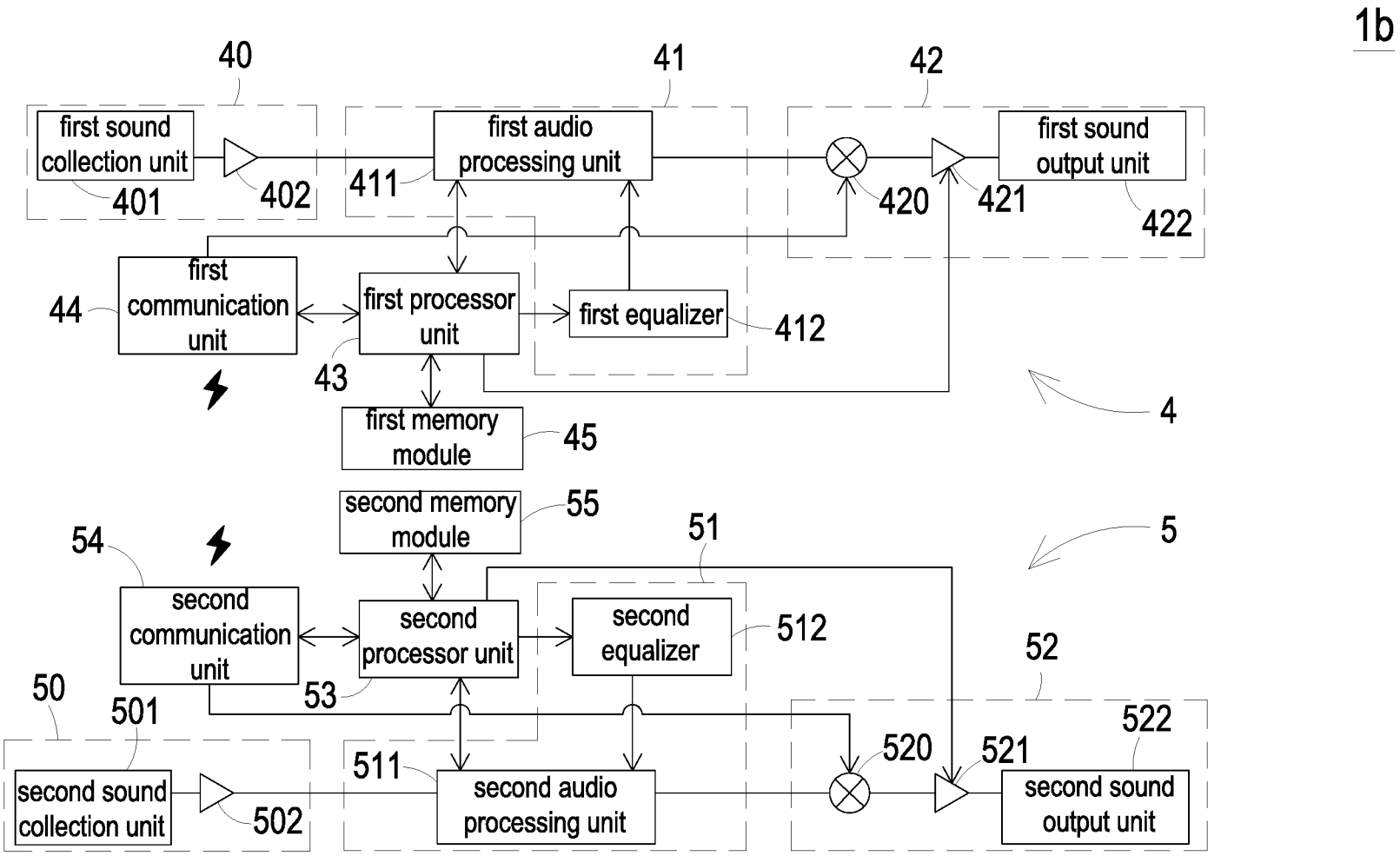
FIG. 2 is a schematic circuit diagram illustrating a hearing assistance system according to a second embodiment of the present disclosure.

FIG. 2 is a schematic circuit diagram illustrating a hearing assistance system according to a second embodiment of the present disclosure. As shown in FIG. 2, the hearing assistance system 1*b* includes a first assisting device 4 and a second assisting device 5. The first assisting device 4 includes a first sound collection module 40, a first audio processing module 41, a first audio output module 42, a first processor unit 43 and a first communication unit 44. The first audio processing module 41 is electrically connected to the first sound collection module 40, the first processor unit 43 and the first audio output module 42 respectively. The first processor unit 43 is electrically connected to the first communication unit 44.

The second assisting device 5 includes a second sound collection module 50, a second audio processing module 51, a second audio output module 52, a second processor unit 53 and a second communication unit 54. The second audio processing module 51 is electrically connected to the second sound collection module 50, the second processor unit 53 and the second audio output module 52 respectively. The second processor unit 53 is electrically connected to the second communication unit 54.

The first sound collection module 40 receives and transmits the first source sound to the first audio processing module 41. The first audio processing module 41 performs audio processing on the first source sound and outputs the first audio signal to the first processor unit 43. The first audio signal includes a first source-sound parameter signal and a first adjusting audio signal. The first source-sound parameter signal is an output parameter signal based on the first source sound. The first adjusting audio signal is an audio signal generated by processing the first source sound with wide dynamic range compression and adjusting the processed first source sound according to the matching formula (e.g., DSL, NAL-NL-2). The second sound collection module 50 receives and transmits the second source sound to the audio processing module 51. The audio processing module 51 performs audio processing on the second source sound and outputs the second audio signal to the second processor unit 53. The second audio signal includes a second source-sound parameter signal and a second adjusting audio signal. The second source-sound parameter signal is an output parameter signal based on the first source sound. The second adjusting audio signal is an audio signal generated by processing the second source sound with wide dynamic range compression and adjusting the processed second source sound according to the matching formula (ex. DSL, NAL-NL-2). The source-sound parameter signal is a value of the volume of source sound, and the unit of the value is for example but not limited to decibel (dB).

The first communication unit 44 and the second communication unit 54 are communicated with each other for transmitting the first and second audio signals to each other. The first processor unit 43 operates according to the first and second audio signals and outputs a first control signal to the first audio processing module 41. The first audio processing module 41 outputs a first output audio signal to the first audio output module 42 in accordance with the first control signal. The first audio outputs module 42 outputs the first sound to one ear of the user in accordance with the first output audio signal.

The second processor unit 53 operates according to the first and second audio signals and outputs a second control signal to the second audio processing module 51. The second audio processing module 51 outputs a second output audio signal to the second audio output module 52 in accordance with the second control signal. The second audio output module 52 outputs the second sound to the other ear of the user in accordance with the second output audio signal.

Consequently, through performing audio processing and volume adjustment on the first and second source sounds by the first audio processing module 41, the first processor unit 43, the second audio processing module 51 and the second processor unit 53, the first and second sounds outputted at last have the volume characteristics corresponding to the first and second source sounds. On the other hand, the first and second sounds are both generated via the wide dynamic range compression and the control signals. By the means of double-sided tuning, the user is able to determine the source orientation of the first and second source sounds in accordance with the first and second sounds heard by ears, and thus the user is allowed to have the spatial perception.

In this embodiment, the specific operating and adjustment process of the hearing assistance system 1*b* to the source sound is exemplified and described as follow.

The first audio processing module 41 and the first processor unit 43 perform audio processing and operation on the first source sound according to the parameter (e.g., the audibility curve of one ear) defaulted in the first assisting device 4, and the first adjusting audio signal is generated accordingly. The second audio processing module 51 and the second processor unit 53 perform audio processing and operation on the second source sound according to the parameter (e.g., the audibility curve of the other ear) defaulted in the second assisting device 5, and the second adjusting audio signal is generated accordingly.

In accordance with the volume relationship between the first and second source-sound parameter signals (i.e., the volume relationship between the first and second source sounds) and the volume relationship between the first and second adjusting audio signals, the first processor unit 43 and the second processor unit 53 adjust the first and second adjusting audio signals respectively. According to the first and second adjusting audio signals, the first processor unit 43 and the second processor unit 53 output the first and second control signals respectively. The first and second control signals are used for controlling the first audio processing module 41 and the second audio processing module 51 to generate the corresponding first and second output audio signals respectively. The way of the first processor unit 43 and the second processor unit 53 adjusting the first and second adjusting audio signals are detailed in Table 2. In Table 2 and the corresponding descriptions, the comparison and adjustment to the audio signal are performed on the volume of the adjusting audio signal. The manners of comparison are not limited to the total volume or the volume of each channel.

TABLE 2

The reference table of the control signal adjusting the volume

| the volume of source sound | the volume of adjusting audio signal | the way of the control signal adjusting the volume |
|---|---|---|
| the first source sound = the second source sound | the first adjusting audio signal = the second adjusting audio signal ±1 dB | no adjustment |
| | the first adjusting audio signal > the second adjusting audio signal | decreasing the first adjusting audio signal successively by 1 dB and increasing the second adjusting audio signal successively by 1 dB until the first adjusting audio signal equaling the second adjusting audio signal |
| | the first adjusting audio signal < the second adjusting audio signal | increasing the first adjusting audio signal successively by 1 dB and decreasing the second adjusting audio signal successively by 1 dB until the first adjusting audio signal equaling the second adjusting audio signal |
| the first source sound > the second source sound | the first adjusting audio signal = the second adjusting audio signal ±1 dB | increasing the first adjusting audio signal by 1 dB and decreasing the second adjusting audio signal by 1 dB |
| | the first adjusting audio signal > the second adjusting audio signal | no adjustment |
| | the first adjusting audio signal < the second adjusting audio signal | increasing the first adjusting audio signal successively by 1 dB and decreasing the second adjusting audio signal successively by 1 dB until the first adjusting audio signal being 3 dB larger than the second adjusting audio signal |
| the first source sound < the second source sound | the first adjusting audio signal = the second adjusting audio signal (±1 dB) | decreasing the first adjusting audio signal by 1 dB and increasing the second adjusting audio signal by 1 dB |
| | the first adjusting audio signal > the second adjusting audio signal | decreasing the first adjusting audio signal successively by 1 dB and increasing the second adjusting audio signal successively by 1 dB until the second adjusting audio signal being 3 dB larger than the first adjusting audio signal |
| | the first adjusting audio signal < the second adjusting audio signal | no adjustment |

For example, in the case that the volume of the first source sound is larger than the volume of the second source sound. If the first adjusting audio signal and the second adjusting audio signal are the same (within an error of 1 dB), the first processor unit 43 increases the first adjusting audio signal by 1 dB and outputs the corresponding first control audio signal, and the second processor unit 53 decreases the second adjusting audio signal by 1 dB and outputs the corresponding second control signal. If the first adjusting audio signal is larger than the second adjusting audio signal, the first processor unit 43 and the second processor unit 53 perform no adjustment and output the first and second control signals according to the first and second adjusting audio signals respectively. If the first adjusting audio signal is smaller than the second adjusting audio signal, the first processor unit 43 increasing the first adjusting audio signal successively by 1 dB and the second processor unit 53 decreasing the second adjusting audio signal successively by 1 dB until the first adjusting audio signal is 3 dB larger than the second adjusting audio signal. The first processor unit 43 and the second processor unit 53 output the corresponding first and second control signals respectively.

In an embodiment, the first sound collection module 40 includes a first sound collection unit 401 and a first gain amplifier 402 electrically connected to each other. The first sound collection unit 401 receives the first source sound, and the first gain amplifier 402 receives and amplifies the first source sound. The first audio processing unit 411 is electrically connected to the first gain amplifier 402 for receiving the amplified first source sound, and the first audio processing unit 411 outputs the first audio signal.

In an embodiment, the first audio processing module 41 includes a first audio processing unit 411 and a first equalizer 412. The first audio processing unit 411 is electrically connected to the first gain amplifier 402, the first processor unit 43 and the first audio output module 42 of the first sound collection module 40. The first audio processing unit 411 receives the amplified first source sound and performs audio processing on the first source sound, and output the first audio signal to the first processor unit 43. The first equalizer 412 is electrically connected between the first processor unit 43 and the first audio processing unit 411. The first equalizer 412 receives the first control signal and controls the first audio processing unit 411 to output the first audio signal in accordance with the first control signal.

In an embodiment, the first audio output module 42 includes a first mixer 420, a first output amplifier 421 and a first sound output unit 422. The first mixer 420 is electrically connected to the first audio processing module 41 and is configured for receiving and outputting the first output audio signal. The first output amplifier 421 is electrically connected to the first mixer 420 and is configured for receiving and amplifying the first output audio signal. The first sound output unit 422 is electrically connected to the first output amplifier 421 and is configured for receiving the amplified first output audio signal and outputting the first sound. In an embodiment, the first communication unit 44 receives the first external audio signal. The first external audio signal can be Bluetooth music signal supporting A2DP, TWS+. The first mixer 420 is electrically connected to the first communication unit 44 for receiving the first external audio signal, and the first mixer 420 outputs one of the received first external audio signal and the received first output audio signal. The first output amplifier 421 amplifies the first output audio signal according to the first parameter. The first output amplifier 421 is electrically connected to the first processor unit 43, and the first processor unit 43 can control and adjust the first parameter.

In an embodiment, the second sound collection module 50 includes a second sound collection unit 501 and a second gain amplifier 502 electrically connected to each other. The second sound collection unit 501 receives the second source sound, and the second gain amplifier 502 receives and amplifies the second source sound.

In an embodiment, the second audio processing module 51 includes a second audio processing unit 511 and a second equalizer 512. The second audio processing unit 511 is electrically connected to the second gain amplifier 502, the second processor unit 53 and the second audio output module 52 of the second sound collection module 50. The second audio processing unit 511 receives the amplified second source sound and performs audio processing on the second source sound, and outputs the second audio signal to the second processor unit 53. The second equalizer 512 is electrically connected between the second processor unit 53 and the second audio processing unit 511. The second equalizer 512 receives the second control signal and controls the second audio processing unit 511 to output the second output audio signal in accordance with the second control signal.

In an embodiment, the second audio output module 52 includes a second mixer 520, a second output amplifier 521 and a second sound output unit 522. The second mixer 520 is electrically connected to the second audio processing module 51 and is configured for receiving and outputting the second output audio signal. The second output amplifier 521 is electrically connected to the second mixer 520 and is configured for receiving and amplifying the second output audio signal. The second sound output unit 522 is electrically connected to the second output amplifier 521 and is configured for receiving the amplified second output audio signal and outputting the second sound. In an embodiment, the second communication unit 54 receives a second external audio signal. The second external audio signal can be Bluetooth music signal supporting A2DP and TWS+. The second mixer 520 is electrically connected to the second communication unit 54 for receiving the second external audio signal, and the second mixer 520 outputs one of the received second external audio signal and the received second output audio signal. The second output amplifier 521 amplifies the second output audio signal according to the second parameter. The second output amplifier 521 is electrically connected to the second processor unit 53, and the second processor unit 53 can control and adjust the second parameter.

In an embodiment, the first assisting device 4 further includes a first memory module 45 electrically connected to the first processor unit 43. The first memory module 45 is configured to store the data and parameters in the first assisting device 4. The second assisting device 5 further includes a second memory module 55 electrically connected to the second processor unit 53. The second memory module 55 is configured to store the data and parameters in the second assisting device 5.

In an embodiment, preferably but not exclusively, the first communication unit 44 and the second communication unit 54 are communicated with each other via wireless transmission system (e.g., Bluetooth, Wifi and Zigbee). In an embodiment, the first communication unit 44 and the second communication unit 54 are communicated with each other via wired transmission system.

Figure 3:
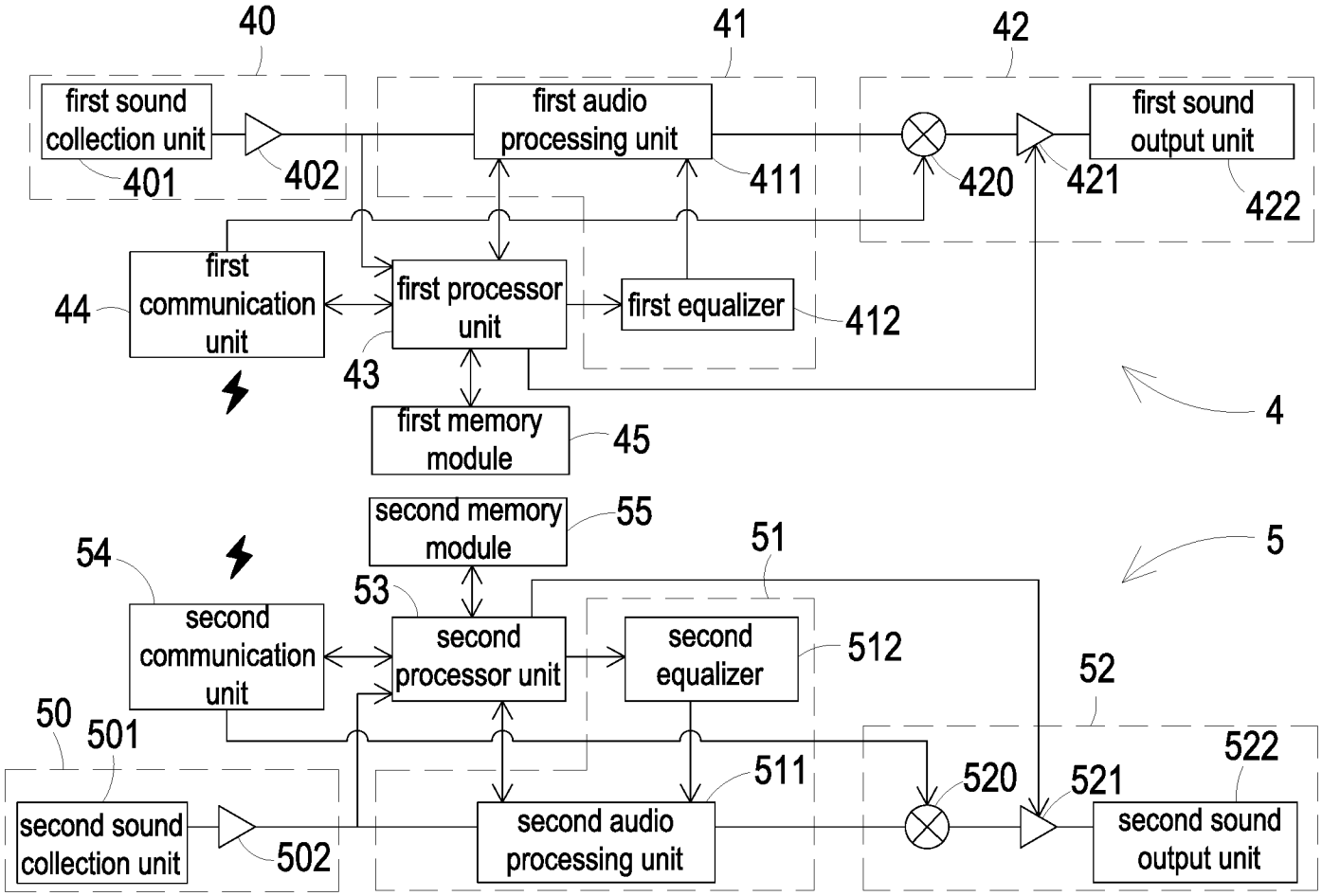
FIG. 3 is a schematic circuit diagram illustrating a hearing assistance system according to a third embodiment of the present disclosure.

In an embodiment, as shown in FIG. 2, the processor unit has no ability of CODEC. For example but not exclusively, the first audio processing unit 411 and the first processor unit 43 are connected to each other through SPI/$I^2C$ interface, and the second audio processing unit 511 and the second processor unit 53 are connected to each other through SPI/$I^2C$ interface. In another embodiment, as shown in FIG. 3, the first processor unit 43 and the second processor unit 53 have ability of CODEC. Therefore, the first and second source sounds amplified by the sound collection module can be directly transmitted to the first processor unit 43 and the second processor unit 53 for decoding process. For example but not exclusively, the first sound collection module 40 and the first processor unit 43 are connected to each other through PCM/$I^2C$ interface, and the second sound collection module 50 and the second processor unit 53 are connected to each other through PCM/$I^2C$ interface. In addition, in the embodiment shown in FIG. 1, the processor unit 33 of the second assisting device 3 has no ability of CODEC. Certainly, in another embodiment, the processor unit 33 may be a processor having the ability of CODEC, so that the processor unit 33 can share the work of the audio processing module 31 and generate the second source-sound parameter signal. Therefore, the audio processing speed of the second assisting device 3 is accelerated, and the possible time latency is reduced. In accordance with the above descriptions about the connecting interface, it is allowed to adjust the circuit connections and the connecting interface of the embodiment shown in FIG. 3. The detailed description and figures thereof are omitted herein.

Figure 4:
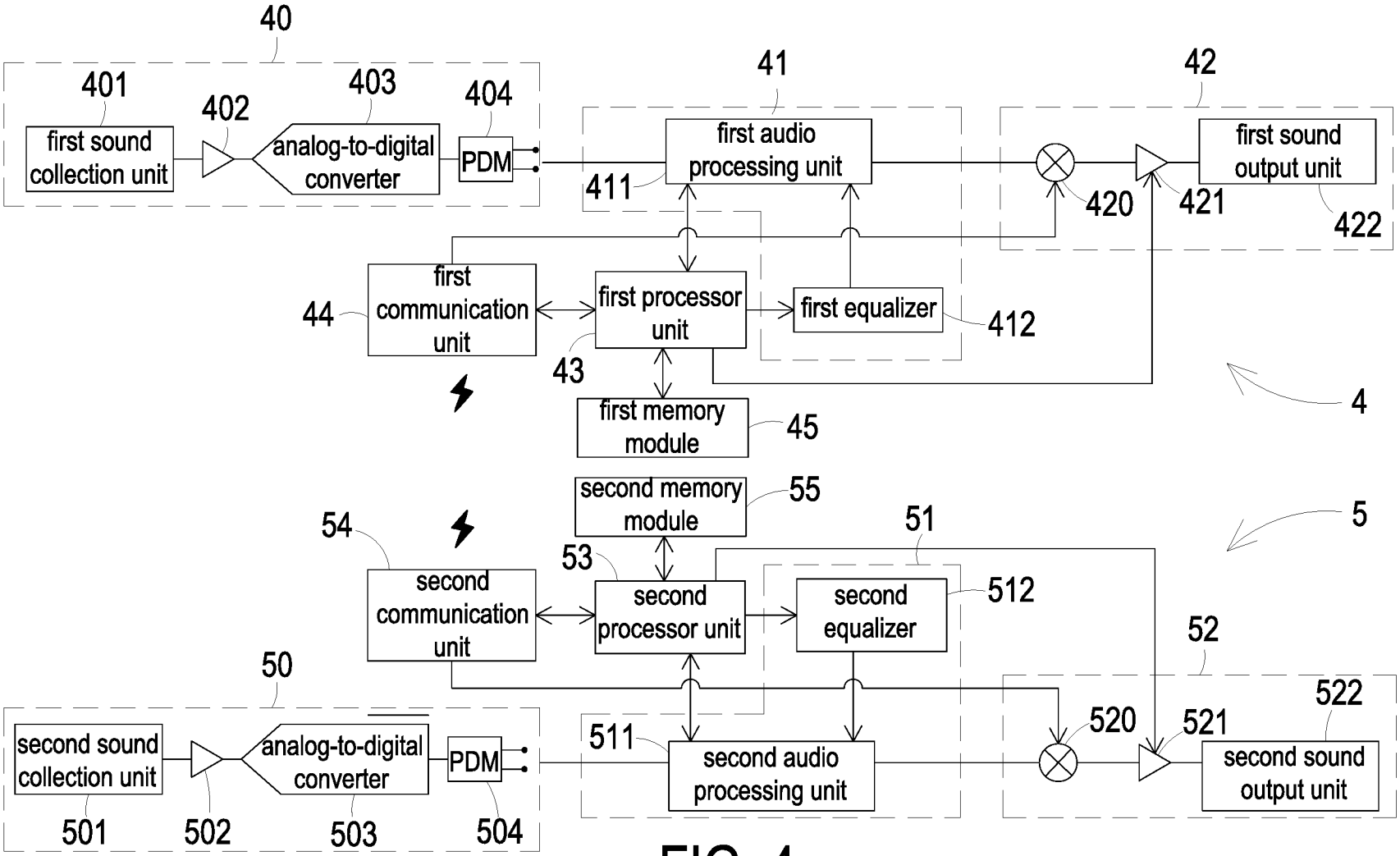
FIG. 4 is a schematic circuit diagram illustrating a hearing assistance system according to a forth embodiment of the present disclosure.

In the embodiment shown in FIG. 2, the sound collection module is analog sound collection module. In another embodiment, as shown in FIG. 4, the sound collection modules 40 and 50 are digital sound collection module. The first sound collection module 40 further includes an analog-to-digital converter (ADC) 403 and a pulse density modulator (PDM) 404. The second sound collection module 50 further includes an analog-to-digital converter (ADC) 503 and a pulse density modulator (PDM) 504. The analog-to-digital converter 403 is electrically connected to the first gain amplifier 402, and the pulse density modulator 404 is electrically connected to the analog-to-digital converter 403. The analog-to-digital converter 503 is electrically connected to the second gain amplifier 502, and the pulse density modulator 504 is electrically connected to the analog-to-digital converter 503. The analog-to-digital converters (403, 503) convert the source sound, which is an analog signal, into the digital signal. The pulse density modulators (404, 504) modulate the digital signal and provide digital output to the corresponding audio processing module (41, 51) in the form of PDM. In addition, in the embodiment shown in FIG. 1, the sound collection module (20, 30) can be analog sound collection module. Certainly, in another embodiment, the sound collection module (20, 30) can be digital sound collection module, and the component and the connecting relationship thereof are also the same with that of the sound collection module (40, 50) shown in FIG. 4. Hence, the detailed description and the figures thereof are omitted herein.

The above digital sound collection module is not limited to providing digital output in the form of PDM. In an embodiment, the digital sound collection module is changed to include a sound collection unit, an analog-to-digital converter (ADC), a filter and a $I^2S$ serial port, which are electrically connected in sequence. The digital sound collection module provides digital output to the corresponding audio processing module in the form of $I^2S$.

In an embodiment, the first assisting device further includes a first microphone array electrically connected to the first audio processing unit. The second assisting device further includes a second microphone array electrically connected to the second audio processing unit. The first and second microphone arrays eliminate the background noise of the first and second source sounds through beamforming signal processing technology.

From the above description, the present disclosure a hearing assistance system. Through the audio signal transmission of the communication unit, the hearing assistance system can perform volume compensation with comprehensively considering the hearing loss level of the two ears and the sound volume heard by the two ears. Therefore, the volume relationship between the sounds heard by the two ears of the user is consistent with that between the source sounds of the two ears. The user is allowed to correctly determine the sound orientation and have the spatial perception.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A hearing assistance system, comprising:

a first assisting device, comprising:

a first sound collection module configured for receiving a first source sound;

a first audio processing unit electrically connected to the first sound collection module and configured for performing audio processing on the first source sound and generating a first audio signal;

a first audio output module electrically connected to the first audio processing module; and a first communication unit electrically connected to the first audio processing unit and configured for transmitting the first audio signal; and a second assisting device, comprising:

a second sound collection module configured for receiving a second source sound;

an audio processing module electrically connected to the second audio collection module and configured for performing audio processing on the second source sound and generating a second audio signal;

a second audio output module electrically connected to the audio processing module;

a processor unit electrically connected to the audio processing module for receiving the second audio signal; and a second communication unit electrically connected to the processor unit and configured for receiving the second audio signal, wherein the processor unit generates a second control signal in accordance with the first audio signal and the second audio signal, the audio processing module outputs a second output audio signal to the second audio output module in accordance with the second control signal, and the second audio output module outputs a second sound in accordance with the second output audio signal, wherein the first sound collection module comprises:

a first sound collection unit configured for receiving the first source sound; and a first gain amplifier electrically connected to the first sound collection unit and configured for receiving and amplifying the first source sound, wherein the second sound collection module comprises:

a second sound collection unit configured for receiving the second source sound; and a second gain amplifier electrically connected to the second collection unit and configured for receiving and amplifying the second source sound.

2. The hearing assistance system according to claim 1, wherein each of the first and second sound collection modules further comprises an analog-to-digital converter and a pulse density modulator, the analog-to-digital converter is configured to convert the amplified first source sound or the amplified second source sound into a digital signal, and the pulse density modulator is configured to modulate the digital signal and output the modulated digital signal to the first audio processing unit or the audio processing module correspondingly.

3. The hearing assistance system according to claim 1, wherein the audio processing module comprises:

a second audio processing unit electrically connected to the second collection module, the processor unit and the second audio output module, wherein the second audio processing unit receives the second source sound and outputs the second audio signal to the processor unit; and an equalizer electrically connected between the processor unit and the second audio processing unit, wherein the equalizer receives the second control signal and controls the second audio processing unit to output the second output audio signal according to the second control signal.

4. The hearing assistance system according to claim 1, wherein the first audio output module comprises:

a first mixer electrically connected to the first audio processing unit and configured for receiving and outputting the first output audio signal;

a first output amplifier electrically connected to the first mixer and configured for receiving and amplifying the first output audio signal; and a first sound output unit electrically connected to the first output amplifier and configured for receiving the amplified first output audio signal and outputting the first sound.

5. The hearing assistance system according to claim 4, wherein the first communication unit receives a first external audio signal, the first mixer is further electrically connected to the first communication unit for receiving the first external audio signal, and the first mixer outputs one of the first external audio signal and the first output audio signal.

6. The hearing assistance system according to claim 1, wherein the second audio output module comprises:

a second mixer electrically connected to the audio processing module and configured for receiving and outputting the second output audio signal;

a second output amplifier electrically connected to the second mixer and configured for receiving and amplifying the second output audio signal; and a second sound output unit electrically connected to the second output amplifier and configured for receiving the amplified second output audio signal and outputting the second sound.

7. The hearing assistance system according to claim 6, wherein the second communication unit receives a second external audio signal, the second mixer is further electrically connected to the second communication unit for receiving the second external audio signal, and the second mixer outputs one of the second external audio signal and the second output audio signal.

8. The hearing assistance system according to claim 1, wherein the first assisting device further comprises a first memory module, the first memory module is configured to store the data or parameters in the first assisting device, the second assisting device further comprises a second memory module, and the second memory module is configured to store the data or parameters in the second assisting device.

9. The hearing assistance system according to claim 1, wherein the first audio signal comprises a first source-sound parameter signal and a first adjusting audio signal, and the second audio signal comprises a second source-sound parameter signal and a second adjusting audio signal.

10. The hearing assistance system according to claim 1, wherein the processor unit generates a first control signal in accordance with the first and second audio signals, the second communication unit transmits the first control signal to the first communication unit, the first audio processing unit outputs a first output audio signal to the first audio output module according to the first control signal, and the first audio output module outputs a first sound in accordance with the first output audio signal.

11. A hearing assistance system, comprising:

a first assisting device, comprising:

a first sound collection module configured for receiving a first source sound;

a first audio processing module electrically connected to the first sound collection module and configured for performing audio processing on the first source sound and generating a first audio signal;

a first audio output module electrically connected to the first audio processing module;

a first processor unit electrically connected to the first audio processing module; and a first communication unit electrically connected to the first audio processing unit and configured for transmitting the first audio signal; and a second assisting device, comprising:

a second sound collection module configured for receiving a second source sound;

a second audio processing module electrically connected to the second audio collection module and configured for performing audio processing on the second source sound and generating a second audio signal;

a second audio output module electrically connected to the second audio processing module;

a second processor unit electrically connected to the second audio processing module; and a second communication unit electrically connected to the second processor unit and configured for transmitting the second audio signal, wherein the first communication unit and the second communication unit communicates with each other for transmitting the first audio signal and the second audio signal to each other, the first processor unit outputs a first control signal to the first audio processing module in accordance with the first and second audio signals, the first audio processing module outputs a first output audio signal to the first audio output module in accordance with the first control signal, the first audio output module outputs a first sound in accordance with the first output audio signal, the second processor unit outputs a second control signal to the second audio processing module in accordance with the first and second audio signals, the second audio processing module outputs a second output audio signal to the second audio output module in accordance with the second control signal, and the second audio output module outputs a second sound in accordance with the second output audio signal, wherein the first sound collection module comprise:

a first sound collection unit configured for receiving the first source sound; and a first gain amplifier electrically connected to the first sound collection unit and configured for receiving and amplifying the first source sound, wherein the second sound collection module comprises:

a second sound collection unit configured for receiving the second source sound; and a second gain amplifier electrically connected to the second sound collection unit and configured for receiving and amplifying the second source sound.

12. The hearing assistance system according to claim 11, wherein each of the first and second sound collection modules further comprises an analog-to-digital converter and a pulse density modulator, the analog-to-digital converter is configured to convert the amplified first source sound or the amplified second source sound into a digital signal, and the pulse density modulator is configured to modulate the digital signal and to output the modulated digital signal to the first audio processing module or the second audio processing module correspondingly.

13. The hearing assistance system according to claim 11, wherein the first audio processing module comprises:

a first audio processing unit electrically connected to the first sound collection module, the first processor unit and the first audio output module, wherein the first audio processing unit receives the first source sound and outputs the first audio signal to the first processor unit; and a first equalizer electrically connected between the first processor unit and the first audio processing unit, wherein the first equalizer receives the first control signal and controls the first audio processing unit to output the first output audio signal.

14. The hearing assistance system according to claim 11, wherein the second audio processing module comprises:

a second audio processing unit electrically connected to the second sound collection module, the second processor unit and the second audio output module, wherein the second audio processing unit receives the second source sound and outputs the second audio signal to the second processor unit; and a second equalizer electrically connected between the second processor unit and the second audio processing unit, wherein the second equalizer receives the second control signal and controls the second audio processing unit to output the second output audio signal.

15. The hearing assistance system according to claim 11, wherein the first audio output module comprises:

a first mixer electrically connected to the first audio processing module and configured for receiving and outputting the first output audio signal;

a first output amplifier electrically connected to the first audio processing module and configured for receiving and amplifying the first output audio signal; and a first sound output unit electrically connected to the first output amplifier and configured for receiving the amplified first output audio signal and outputting the first sound.

16. The hearing assistance system according to claim 15, wherein the first communication unit receives a first external audio signal, the first mixer is further electrically connected to the first communication unit for receiving the first external audio signal, and the first mixer outputs one of the first external audio signal and the first output audio signal.

17. The hearing assistance system according to claim 11, wherein the second audio output module comprises:

a second mixer electrically connected to the second audio processing module and configured for receiving and outputting the second output audio signal;

a second output amplifier electrically connected to the second mixer and configured for receiving and amplifying the second output audio signal; and a second sound output unit electrically connected to the second output amplifier and configured for receiving the amplified second output audio signal and outputting the second sound.

18. The hearing assistance system according to claim 17, wherein the second communication unit receives a second external audio signal, the second mixer is further electrically connected to the second communication unit for receiving the second external audio signal, and the second mixer outputs one of the second external audio signal and the second output audio signal.

19. The hearing assistance system according to claim 11, wherein the first assisting device further comprises a first memory module, the first memory module is configured to store the data or parameters in the first assisting device, the second assisting device further comprises a second memory module, and the second memory module is configured to store the data or parameters in the second assisting device.

20. The hearing assistance system according to claim 11, wherein the first audio signal comprises a first source-sound parameter signal and a first adjusting audio signal, and the second audio signal comprises a second source-sound parameter signal and a second adjusting audio signal.

* * * * *